United States Patent [19]

Becker et al.

[11] 4,272,037

[45] Jun. 9, 1981

[54] LAP CREEL

[76] Inventors: Josef Becker; Hubert Becker; Matthias Becker, all of Niederforstbacher Str. 80 - 84, 5100 Aachen - Brand, Fed. Rep. of Germany

[21] Appl. No.: 82,803

[22] Filed: Oct. 9, 1979

[30] Foreign Application Priority Data

Oct. 16, 1978 [DE] Fed. Rep. of Germany ..... 2845053

[51] Int. Cl.[3] ..... B65H 75/20

[52] U.S. Cl. ..... 242/118.1; 68/198

[58] Field of Search ..... 242/118.1, 118.11, 118.2, 242/72 R, 118.3; 68/189, 198

[56] References Cited

U.S. PATENT DOCUMENTS 4,180,219 12/1979 Becker et al. ..... 242/118.1

FOREIGN PATENT DOCUMENTS 552597 5/1923 France ..... 242/118.1

*Primary Examiner*—Leonard D. Christian

*Attorney, Agent, or Firm*—W. G. Fasse; D. F. Gould

[57] ABSTRACT

The invention relates to a lap creel made of rod shaped carrying members (1) which form, together with ring shaped fixing elements (2–6) a circular cage. The carrying members (1) project radially outwardly across a portion of the fixing elements (2–6). A fixing element (2) arranged at one end of the lap creel, has inwardly opening grooves (10), the number of which corresponds to the number of carrying members (1). Through these means the appropriate end of the lap creel receives a free-space inner cross-section which corresponds to the outer cross-section of the opposite end of the lap creel. The outer surfaces (7) of the carrying members (1) form parts of a shell which is shaped so that an imaginary enveloping of the lap creel in the central region has a contraction (8). The lap creel thus receives a bi-conical shape; that is, a shape which occurs if two truncated cones at the smaller of the end face diameters are arranged end to end. With the lap creel according to the invention, the lower portion with larger diameter may also be shaped almost cylindrical.

5 Claims, 1 Drawing Figure

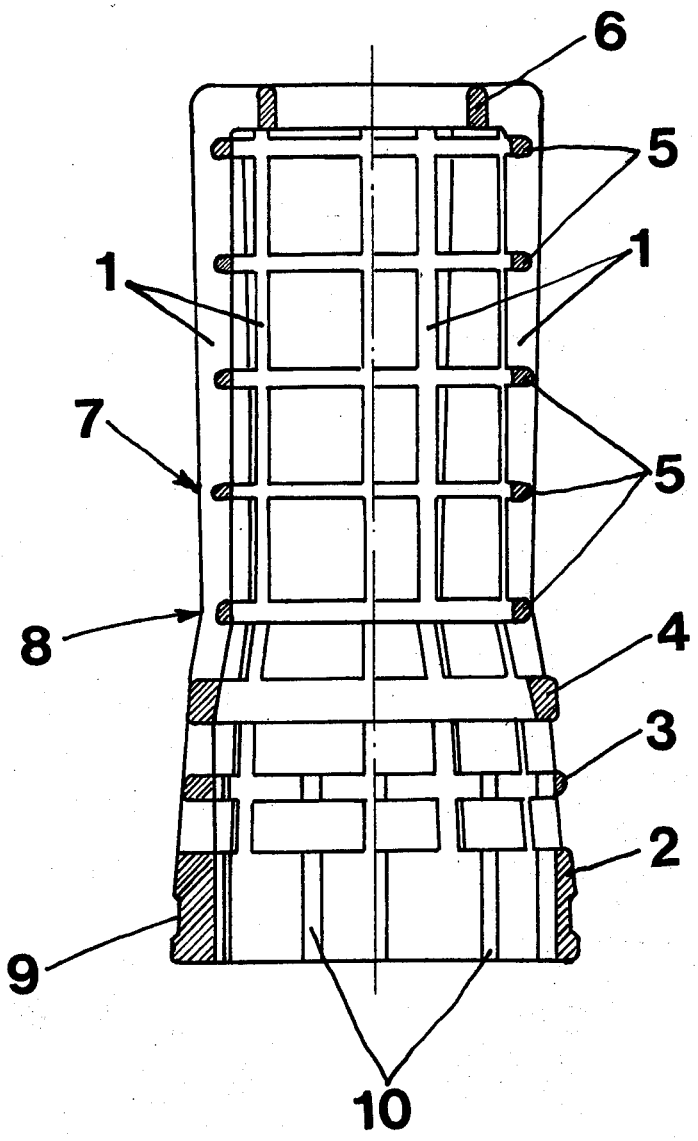
6
5
1
1
7
5
8
4
3
2
9
10

LAP CREEL

BACKGROUND OF THE INVENTION

The invention relates to a lap creel made of rod shaped carrying members, which form, together with ring shaped fixing elements, a circular cage, from which the carrying members project radially outwardly at least over a portion of the fixing elements. One fixing element is arranged at one end of said lap creel, said one fixing element having inwardly opening grooves each of which is located between two carrying members, whereby the free-space inner cross-section of the lap creel bounded by said fixing element is broadened, so that the free-space inner cross-section encompasses the contour of the outer periphery of the opposite end of the lap creel.

Various lap creels made of rod shaped carrying members for taking up of thread type textile goods are already known. The carrying members of these lap creels extend parallel or angularly toward the center line of the lap creel, and they extend radially outwardly into a common cylinder surface or truncated cone surface.

In one known embodiment of a lap creel, wherein the carrying members form parts of a cylinder surface, a fixing element arranged at one end of the lap creel has openings which are essentially adapted to the cross-section of the carrying members. The number and arrangement of the openings corresponds to the number and arrangement of the carrying members, so that the lap creel may be partially inserted coaxially into a lap creel of the same construction. Besides the fixing element provided with the openings, additional fixing elements are distributively arranged across the height of the carrying members. Thus, the lap creels may be inserted one into the other only so far, until ends of the carrying members of one lap creel abut against a fixing element of the other lap creel.

Lap creels of this type of construction not only have the advantage that they require less space for transporting and storage when they are inserted into one another, additionally they also make possible a uniform compression of, for example, wound-on thread like textile material, because the extent to which one lap creel may be inserted into another is definitely limited.

This known embodiment however, has the disadvantage common to all lap creels with a cylindrical winding surface. That is, they are not able to sufficiently fix, especially the first thread courses resting immediately on the lap creel. Consequently, the winding process at the beginning and the unwinding process at the end may be significantly disturbed. However, a lap creel, the carrying members of which forms parts of a common truncated cone surface, is affected by the same disadvantage, because in such a structure the winding courses immediately contacting the carrying surface have the tendency to shift toward the tapered part of the lap creel. The shifting of the winding courses may, though, be avoided by fixing means projecting beyond the carrying members at the ends of the lap creel. However, such fixing means projecting beyond the winding surface prevent the forming of a freely accessible thread reserve, which serves in the further processing of the textile materials, to connect in advance the end of one creel with the beginning of another. There is also no chance, for example, to form a freely accessible thread reserve in the instance of the known cylindrical lap creel described above. This is so, because the fixing element provided with the holes and projecting beyond the carrying members interferes with a thread reserve, and a thread reserve situated at the opposite end could slide off the lap creel unhindered.

OBJECTS OF THE INVENTION

It is the aim of the invention, to develop a lap creel which may be coaxially inserted into a lap creel of the same construction for a definite proportion of its height, so that especially the winding courses immediately contacting the winding surface of the creel are prevented from haphazardly shifting beyond the height of the lap creel; and on which lap creel the formation of a thread reserve which is also prevented from accidental shifting and still freely accessible, is possible.

SUMMARY OF THE INVENTION

In order to achieve the stated aim, it is suggested, starting from the lap creel described above, that the outer surfaces of the rod shaped carrying members form parts of a common bi-conical shell, wherein a contraction of the shell diameter lies in the central region of the lap creel.

The lap creel according to the invention prevents, by means of the contraction of the winding surface in the central region, a possible shifting toward one or the other end of the lap creel, especially of the winding layers arranged immediately on the winding surface, which winding layers thus have a tendency to shift. Furthermore, the bi-conicity of the winding surface makes it superfluous to allow the fixing elements to project beyond the carrying members at the ends of the lap creel which would otherwise interfere with the free accessibility of a thread reserve.

According to one embodiment of the invention, the carrying members project radially outwardly beyond the fixing elements over a cone portion of the bi-conical shell extending somewhat more than $\frac{2}{3}$ of the lap creel height.

As a result of the construction according to the invention, the rod shaped carrying members may be dimensioned, so that they provide the lap creel with an especially large inherent stiffness, without the need for manufacturing the lap creel of particularly high strength material.

According to a further embodiment of the invention, outer surfaces of the carrying members and of the fixing elements form common parts of the bi-conical shell across a cone section extending somewhat more than $\frac{1}{3}$ of the lap creel height.

This construction of the invention gives the lap creel sufficient space for the taking-up of a fixed thread reserve which is completely freely accessible and which is still unable to shift.

A further embodiment of the invention provides that the outer surfaces of the carrying members and of the fixing elements which form common parts of the bi-conical shell, are roughened in order to also insure that the thread reserve and thus the first winding courses, are secured against an accidental radial shifting.

Finally, a further embodiment of the invention provides that an annular groove is provided on the roughened outer surface of the fixing element bounding the lap creel at the end of the maximum lap creel outer diameter. This annular groove is for embedding of the thread reserve.

BRIEF FIGURE DESCRIPTION

In order that the invention may be clearly understood, it will now be described, by way of example, with reference to the single FIGURE of the accompanying drawings showing a longitudinal sectional view through a lap creel according to the invention.

DETAILED DESCRIPTION OF AN EXAMPLE EMBODIMENT AND OF THE BEST MODE OF THE INVENTION

Rod shaped carrying members 1, together with ring shaped fixing elements 3, 4, 5, and 6, form a circular cage, wherein outer surfaces of the carrying members 1 are arranged flush relative to the outer surfaces of the fixing elements 2, 3, and 4, whereas the carrying members 1 project radially outward beyond the outer surfaces of the fixing elements 5 and 6.

The outer surfaces of the rod shaped carrying members 1 together form parts 7 of a bi-conical shell with a maximum contraction 8 in the central region of the lap creels, which contraction 8 is spaced about ⅓ of the lap creel height from the end of the lap creel bounded by the fixing element 2. The outer surfaces of the carrying members 1 within this cone region, together with the outer surfaces of the fixing elements 2, 3, and 4, form parts of the bi-conical shell and have a roughened outer surface. The outer surface of the fixing element 2 is additionally provided with an annular groove 9 for taking up a non-illustrated thread reserve.

Grooves 10 are located on the inner side of the fixing elements 2 and 3. Each of these grooves 10 is arranged between two neighboring carrying members 1. The grooves 10 widen the free-space inner cross-section of the lap creel in the region of the fixing elements 2 and 3, so that this free-space cross-section is able to receive the end region of the opposite end of the lap creel. Because of this construction, two lap creels of the same dimensioning may be inserted into one another co-axially to a limited extend, whereby the limiting occurs, in that end face portions of the carrying members 1, projecting beyond the fixing member 6, abut against the bottom surface of the fixing element 4, which, in contrast to the fixing elements 2 and 3, does not have any grooves.

The lap creel according to the invention assures, because of its construction, the unimpeded insertability of one into the other by an exactly defined amount, and at the same time guarantees that an accidental shifting of the winding material in the direction of the ends of the lap creel is prevented. This shifting may not be avoided either by lap creels with a cylindrically shaped winding surface or by those with a simple cone shaped winding surface.

Although the invention has been described with reference to specific example embodiments, it is to be understood, that it is intended to cover all modifications and equivalents within the scope of the appended claims.

We claim:

1. A lap creel having a longitudinal axis and top and bottom ends, comprising rod shaped carrying members (1) each having a substantially rectangular cross-section in a direction extending substantially radially relative to said longitudinal axis, a first number of ring shaped holding means (2, 3) and a second number of ring shaped holding means (5) operatively connected to said rod shaped carrying members (1) to form a cage, each of said carrying members (1) having a longitudinal shape with a first part that widens toward said bottom end of the creel and with a second part that widens toward the top end of the creel, whereby a lower conical cage portion and an upper conical cage portion are formed which merge into each other where said cage has its smallest outer diameter intermediate said bottom and top ends, said first number of ring shaped holding means being connected to said carrying members along said first part thereof so that said ring shaped holding means and said carrying members are substantially flush with one another in the radially outward direction along said lower conical cage portion, said second number of ring shaped holding means being connected to said carrying members along said second part thereof so that said carrying members protrude radially outwardly relative to said ring shaped holding means along said upper conical cage portion, said first number of ring shaped holding means comprising at least one ring located at said bottom end and having inwardly facing, axially extending grooves (10) positioned intermediate adjacent carrying members and radially spaced from one another so that said lap creel is insertable with its top end into another lap creel of the same construction.

2. The lap creel of claim 1, wherein said first number of ring shaped holding means comprise at least one further ring (4) located adjacent said smallest outer cage diameter and arranged to provide a stop for the top end of another lap creel inserted into the bottom end of the lap creel.

3. The lap creel of claim 1, having a given axial length, said lower conical cage portion having an axial length corresponding to about ⅓ of said given axial length and said upper conical cage portion having an axial length corresponding to about ⅔ of said given axial length, said carrying members protruding radially outwardly from said ring shaped holding means along said ⅔ axial length.

4. The lap creel of claim 1, wherein said rod shaped carrying members have radially outwardly facing first surface means and wherein said first number of ring shaped holding means also have radially outwardly facing further surface means, said first and further surface means being roughened along said lower conical cage portion.

5. The lap creel of claim 1, wherein said at least one ring (2) located at said bottom end has a roughened surface facing radially outwardly and a ring groove (9) in said radially outwardly facing surface for taking up a thread reserve.

* * * * *